US009850782B2

(12) United States Patent
de Lausnay

(10) Patent No.: US 9,850,782 B2
(45) Date of Patent: Dec. 26, 2017

(54) TURBINE EXHAUST DUCT DESIGN FOR AIR COOLED CONDENSERS

(71) Applicant: Evapco, Inc., Taneytown, MD (US)

(72) Inventor: Raf de Lausnay, Bridgewater, NJ (US)

(73) Assignee: Evapco, Inc., Taneytown, MD (US)

( * ) Notice: Subject to any disclaimer, the term of this patent is extended or adjusted under 35 U.S.C. 154(b) by 848 days.

(21) Appl. No.: 13/906,552

(22) Filed: May 31, 2013

(65) Prior Publication Data

US 2013/0333349 A1 Dec. 19, 2013

Related U.S. Application Data

(60) Provisional application No. 61/653,613, filed on May 31, 2012.

(51) Int. Cl.

| | |
|---|---|
| ***F01K 7/00*** | (2006.01) |
| ***F01D 1/24*** | (2006.01) |
| ***F01D 25/30*** | (2006.01) |
| ***F01D 25/32*** | (2006.01) |
| ***F28B 9/02*** | (2006.01) |

(52) U.S. Cl.

CPC ..... *F01K 7/00* (2013.01); *F01D 1/24* (2013.01); *F01D 25/30* (2013.01); *F01D 25/32* (2013.01); *F28B 9/02* (2013.01)

(58) Field of Classification Search

CPC ... F01K 7/00; F01D 1/24; F01D 25/30; F01D 25/32; F28B 9/02

See application file for complete search history.

(56) References Cited

U.S. PATENT DOCUMENTS

| | | | |
|---|---|---|---|
| 3,814,177 | A | 6/1974 | Harris et al. |
| 2005/0161094 | A1 | 7/2005 | Schmidt |

OTHER PUBLICATIONS

International Search Report issued in corresponding international application No. PCT/US2013/043573 dated Oct. 31, 2013.

*Primary Examiner* — Craig Kim

(74) *Attorney, Agent, or Firm* — Whiteford, Taylor & Preston, LLP; Peter J. Davis

(57) ABSTRACT

A double turbine exhaust duct design and an inline V turbine exhaust duct design that both eliminate the need for the standard T-piece in a turbine exhaust duct assembly, substantially reducing the steam-side pressure drop, minimizing the sub-cooling in the steam cycle (the temperature difference between ACC condensate temperature out and turbine steam temperature), thus improving the overall efficiency of the steam cycle plant heat rate.

7 Claims, 7 Drawing Sheets

TURBINE EXHAUST DUCT DESIGN FOR AIR COOLED CONDENSERS

CROSS REFERENCE TO RELATED APPLICATION

This application claims priority from U.S. Provisional Application No. 61/653,613 filed on May 31, 2012, and entitled "IMPROVED TURBINE EXHAUST DUCT DESIGN," the specification of which is incorporated herein by reference in its entirety.

FIELD OF THE INVENTION

The present invention relates to air cooled condensers. In particular, the invention relates to new designs for turbine exhaust ducts for air cooled condensers.

BACKGROUND OF THE INVENTION

Air cooled condensers are used in the power generation industry to cool the steam exhaust from a steam turbine and convert it to water for return to the power generation cycle. The spent steam from a power generation steam turbine is typically delivered to a turbine exhaust duct which carries the steam to multiple air cooled condenser sections or "streets," arranged in parallel. According to typical arrangements, a horizontal turbine exhaust duct approaches the center of the air cooled condenser (ACC) assembly where it meets with a large and intricate T-piece that contains guide vanes to direct the steam. The T-piece, with the help of the guide vanes, splits the exhaust flow, directing half of the steam in one direction along the ACC assembly and directing the other half of the steam in the other direction along the ACC assembly, see, e.g., FIGS. 1-3.

The horizontal turbine exhaust duct and the T-piece are each constructed of arcuate shell plates, FIG. 4. Prior to assembly into the turbine exhaust duct and T-piece, the arcuate shell plates are stacked on steel frames and shipped to the final assembly location in standard sized shipping containers. At the final assembly location, the shell plates are removed from the shipping containers, stood on their edges, and welded to one another to form annular sections. The annular sections are then stacked upon one-another vertically and welded to one-another to form a vertical stack or "can," FIG. 5. Once fully welded, the stacks are tipped into a horizontal position and moved into their final location. FIGS. 6 and 7 show assembly of shell plates and guide vanes into the T-piece.

SUMMARY OF THE INVENTION

Field assembly and welding of the steam turbine exhaust duct T piece is often the most difficult and time consuming aspects of ACC assembly. Purchasers of ACCs and the erectors who assemble them in the field face very high costs to install them, and one of the contributory factors to the high install cost is the amount of labor and man hours it takes to do the field assembly and welding of the T piece. The field welding is very expensive when compared to the cost of welding done in the factory. Additionally, field welding is often less efficient and it is harder to control quality.

According to the present invention, there is presented a change in the design of the ACC which would result in substantially less field welding, making ACCs having this design much more attractive to purchase and erect.

According to embodiments of the invention, ACCs will cost less money to fabricate, as the new design will lessen the amount of ducting that is needed to be shipped to the site, and reduce the amount of field assembly and welding.

According to one aspect of the invention, there is provided a double turbine exhaust duct design that eliminates the need for the conventional T-piece in a turbine exhaust duct assembly.

According to another aspect of the invention, there is provided a turbine exhaust duct assembly configured to approach a field-assembled air-cooled condenser between a first riser and a second riser and to feed steam to at least said first and second risers, including a first set of two or more turbine exhaust ducts configured to receive steam from a turbine and to approach said air cooled condenser in substantially parallel configuration, a second set of two or more turbine exhaust ducts configured to run approximately perpendicular to streets of said air cooled condenser, each said turbine exhaust ducts in said second set configured to receive steam from a single turbine exhaust duct in said first set of turbine exhaust ducts via an exhaust duct elbow unit, wherein said second set of two or more turbine exhaust ducts are each connected to one or more risers, each of which are configured to supply steam to a single street of said air cooled condenser.

According to another aspect of the invention, there is provided a turbine exhaust duct assembly for a field-assembled air-cooled condenser including a single primary turbine exhaust duct connected at a first end to a turbine or to a turbine to exhaust duct transition element and connected at a second end to a first end of a single-flow-to-multiple-parallel-flow divider duct element, said divider duct element connected at an opposite end to two or more subsidiary elbow and duct assemblies each of which is configured to supply steam to one or more streets of said field assembled air-cooled condenser.

According to another aspect of the invention, there is provided a turbine exhaust duct assembly comprising a round-to-oval single flow to multiple parallel flow divider element, a plurality of elbow units attached at one end to a multiple flow end of said flow divider and attached at another end to single sloping riser duct, each said sloping riser duct configured to supply steam to one or more streets of said air cooled condenser According to another aspect of the invention, there is provided an inline V turbine exhaust duct design that eliminates the need for the conventional T-piece in a turbine exhaust duct assembly.

According to another aspect of the invention, there is provided a turbine exhaust duct design and assembly that avoids the need for a T-piece.

According to another aspect of the invention, there is provided a double duct turbine exhaust duct assembly that eliminates the T-piece, substantially reducing the steam-side pressure drop, minimizing the sub-cooling in the steam cycle (the temperature difference between ACC condensate temperature out and turbine steam temperature), thus improving the overall efficiency of the steam cycle plant heat rate (more electrical MW out, less BTUs in).

According to another aspect of the invention, there is provided an inline V turbine exhaust duct assembly that eliminates the T-piece, substantially reducing the steam-side pressure drop, minimizing the sub-cooling in the steam cycle (the temperature difference between ACC condensate temperature out and turbine steam temperature), thus improving the overall efficiency of the steam cycle plant heat rate (more electrical MW out, less BTUs in).

According to another aspect of the invention, there is provided a method for substantially reducing the steam-side pressure drop, minimizing the sub-cooling in the steam cycle (the temperature difference between ACC condensate temperature out and turbine steam temperature), thus improving the overall efficiency of the steam cycle plant heat rate (more electrical MW out, less BTUs in), the method comprising delivery of spent plant steam to an ACC via a double duct turbine exhaust duct assembly, without the T-piece used in a conventional turbine exhaust design.

According to another aspect of the invention, there is provided a method for substantially reducing the steam-side pressure drop, minimizing the sub-cooling in the steam cycle (the temperature difference between ACC condensate temperature out and turbine steam temperature), thus improving the overall efficiency of the steam cycle plant heat rate (more electrical MW out, less BTUs in), the method comprising delivery of spent plant steam to an ACC via an inline V turbine exhaust duct assembly, without the T-piece used in a conventional turbine exhaust design.

According to another aspect of the invention, there is provided a method for reducing the required size of an ACC for a specified plant steam output and/or lowering the fan horsepower requirements of an ACC by reducing steam side pressure drop, the method comprising delivery of spent plant steam to an ACC via a double duct turbine exhaust duct assembly, without the T-piece used in a conventional turbine exhaust design.

According to another aspect of the invention, there is provided a method for reducing the required size of an ACC for a specified plant steam output and/or lowering the fan horsepower requirements of an ACC by reducing steam side pressure drop, the method comprising delivery of spent plant steam to an ACC via an inline V turbine exhaust duct assembly, without the T-piece used in a conventional turbine exhaust design.

According to another aspect of the invention, there is provided a method for facilitating de-aeration of a steam condensate, reducing corrosion in the steam cycle and for increasing the life of a power plant, the method comprising delivery of spent plant steam to an ACC via a double duct turbine exhaust duct assembly, without the T-piece used in a conventional turbine exhaust design.

According to another aspect of the invention, there is provided a method for facilitating de-aeration of a steam condensate, reducing corrosion in the steam cycle and for increasing the life of a power plant, the method comprising delivery of spent plant steam to an ACC via an inline V turbine exhaust duct assembly.

DESCRIPTION OF THE DRAWINGS

The subsequent description of the preferred embodiments of the present invention refers to the attached drawings, wherein.

DETAILED DESCRIPTION OF THE INVENTION

In the following description, numerous details are set forth to provide a more thorough explanation of the present invention. It will be apparent, however, to one skilled in the art, that the present invention may be practiced without these specific details.

Figure 1:
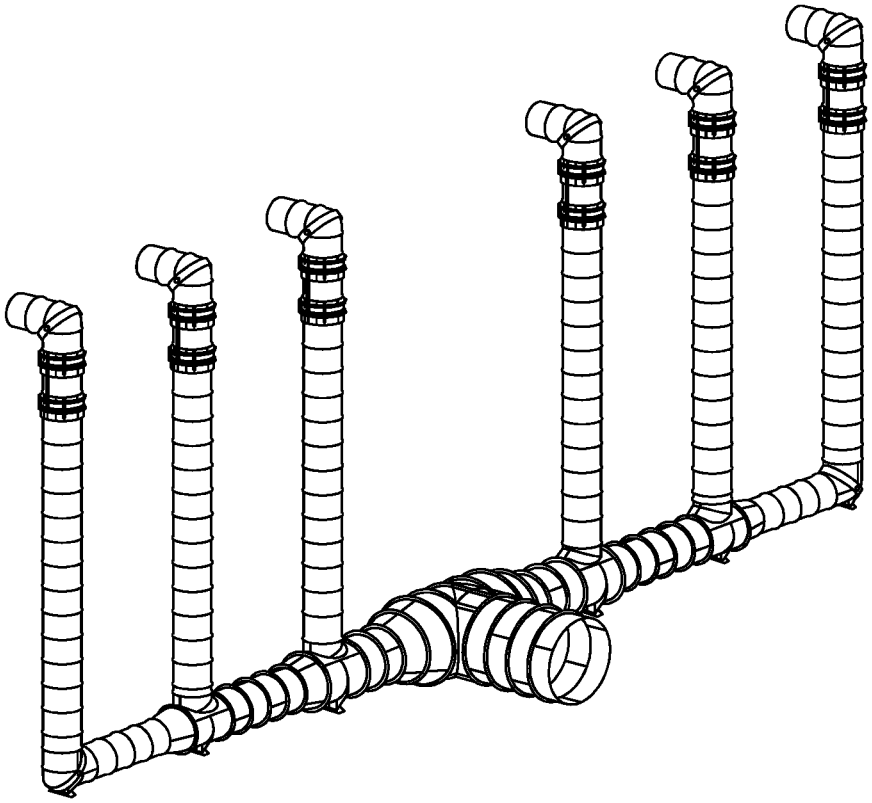
FIG. 1 PRIOR ART
FIG. 1 is a perspective schematic view of a prior art air cooled condenser ("ACC") turbine exhaust duct including T-piece with guide vanes.
Figure 8:
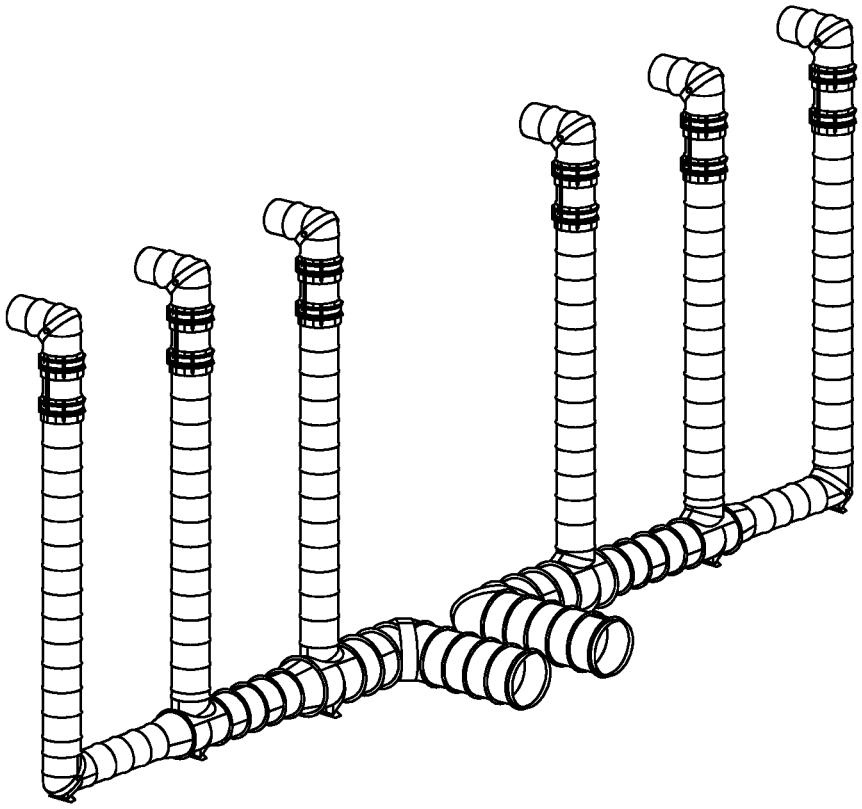
FIG. 8 is a perspective schematic view of an embodiment of a double duct turbine exhaust duct design according to an embodiment of the invention.

FIG. 8 shows a double duct turbine exhaust duct system according to an embodiment of the invention. Prior art turbine exhaust systems approach an industrial air cooled condenser with a single duct and then divide the steam exhaust in opposite directions using a large and complicated T-piece fitted with guide vanes, see, e.g., FIGS. 1-3. In contrast, FIG. 8 shows an embodiment of the invention in which the steam exhaust either leaves the turbine or turbine transition piece in two separate streams or is divided into two separate streams shortly after it leaves the turbine transition piece. Each exhaust stream then separately approaches the ACC in its own turbine exhaust duct, and then is turned, without splitting, to flow perpendicular to the ACC streets before being directed up the riser streets. According to the embodiment shown in FIG. 8, each turbine exhaust duct turns 90°, but the angle of the bend and the corresponding elbow piece can vary according to system/layout requirements anywhere from anywhere from 0° (straight through, no bend) up to 90° or even more than 90°.

According to an additional advantage of this embodiment, the size of the exhaust tubes may be reduced by as much as 50% making it feasible to ship circumferentially assembled ducts to the final assembly location, significantly reducing the amount of field assembly and welding required. That is, instead of delivering many individual shell plates to make into a single run of TED (Turbine Exhaust Duct) and T piece at the site, embodiments of the invention provides the alternative of providing two circumferentially whole ducts. While the shipping of circumferentially assembled turbine exhaust ducts to the final assembly location requires break bulk load shipping, resulting in increased shipping costs, as well as increased manufacturing costs due to the shift of welding from the field to the factory, the elimination of significant field assembly and welding, and attendant difficulties, may be sufficient in some cases to offset the additional costs.

Figure 2:
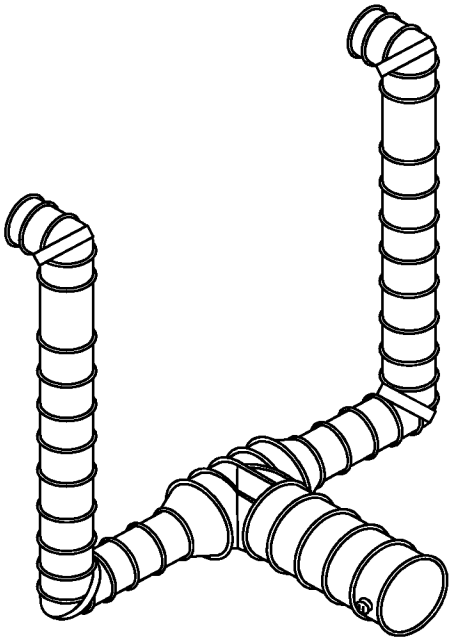
FIG. 2 PRIOR ART
FIG. 2 is a perspective schematic view of a prior art air cooled condenser ("ACC") turbine exhaust duct for a two-street ACC including T-piece with guide vanes.
Figure 3:
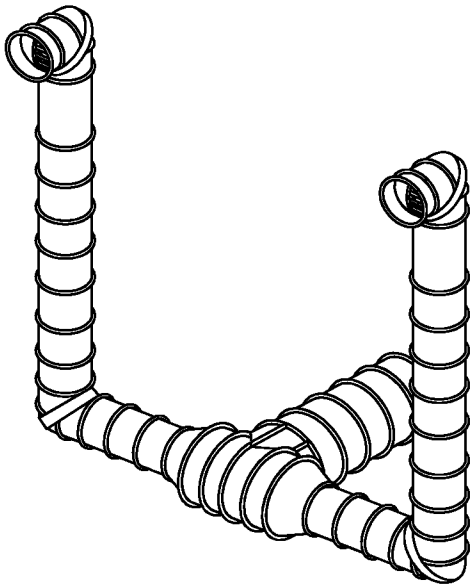
FIG. 3 PRIOR ART
FIG. 3 is a reverse perspective schematic view of a prior art air cooled condenser ("ACC") turbine exhaust duct shown in FIG. 2.
Figure 4:
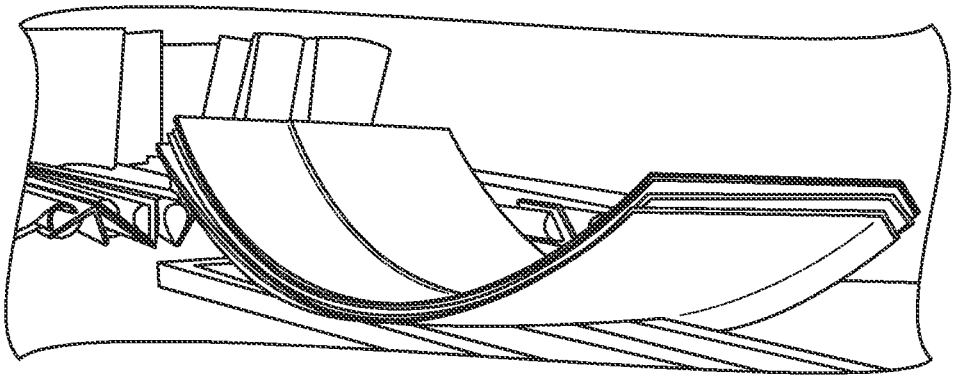
FIG. 4 shows arcuate shell plates used to assemble a prior art turbine exhaust duct and T-Piece, stacked on a shipping palette.
Figure 5:
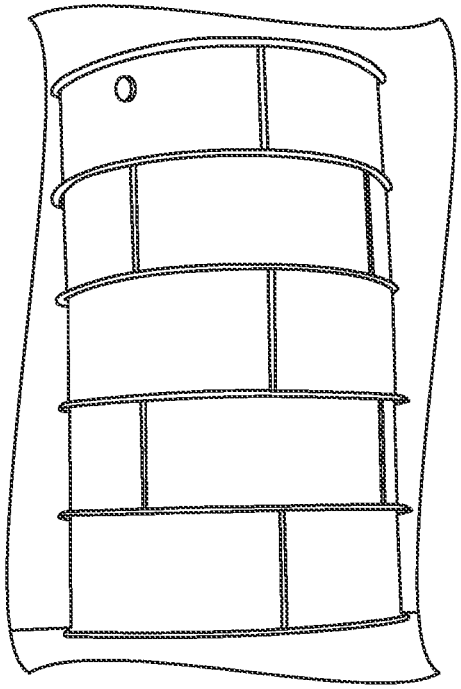
FIG. 5 shows arcuate shell plates welded to one-another into annular sections, which in turn are stacked on top of one-another and welded to form a prior art turbine exhaust duct, in vertical assembly orientation.
Figure 6:
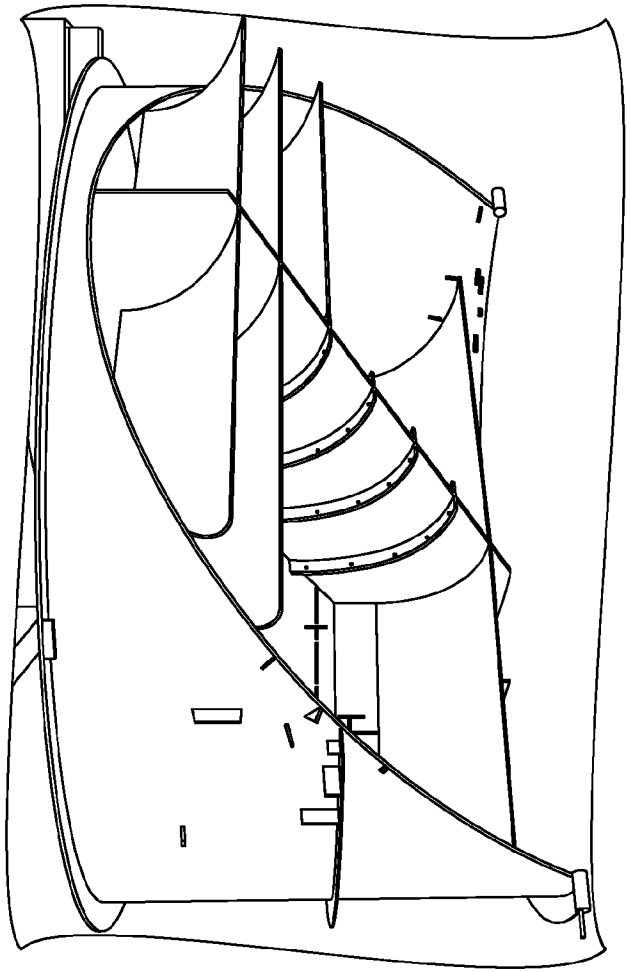
FIG. 6 shows a partially assembled T-piece, including guide vanes.
Figure 7:
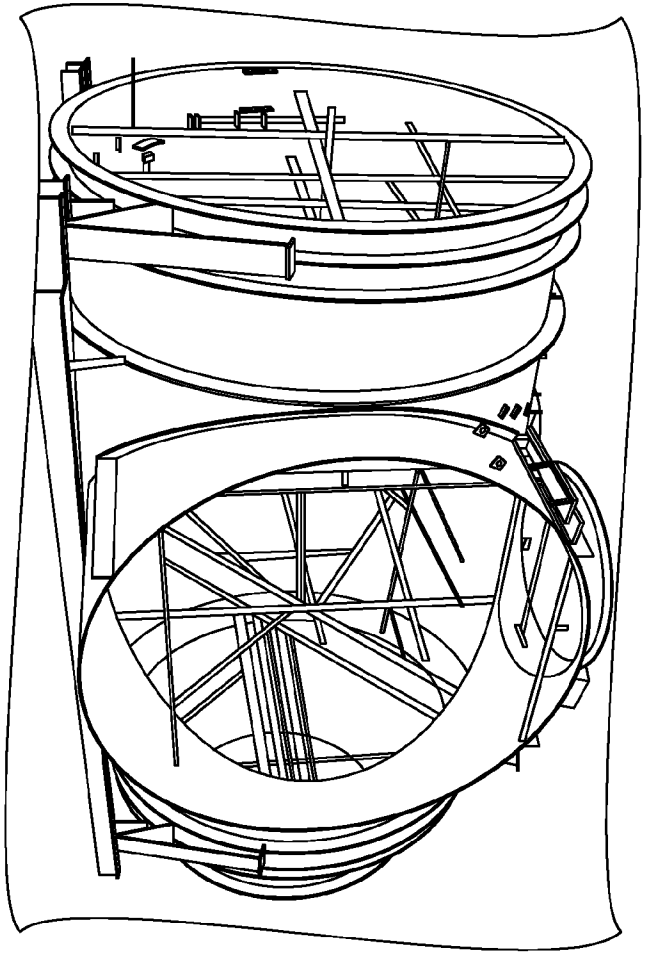
FIG. 7 shows another partially assembled T-piece.
Figure 9:
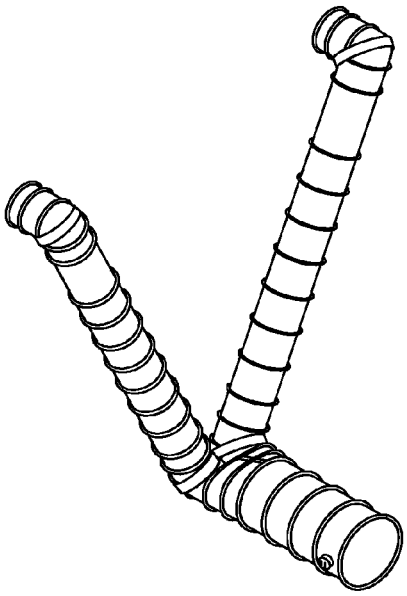
FIG. 9 is a perspective schematic view of an embodiment of an inline V turbine exhaust duct design according to an embodiment of the invention.
Figure 10:
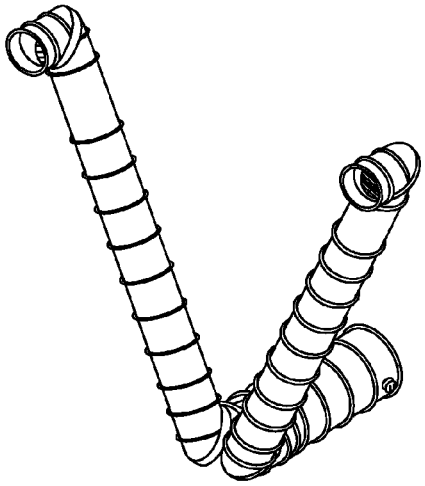
FIG. 10 is another perspective schematic view of the inline V turbine exhaust duct design shown in FIG. 9.
Figure 11:
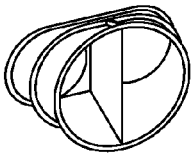
FIG. 11 is a perspective schematic view of a round to oval reducer for use with an inline V turbine exhaust duct.
Figure 12:
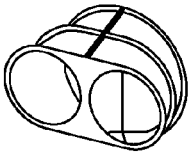
FIG. 12 is a reverse perspective schematic view of the round to oval reducer shown in FIG. 11.
Figure 13:
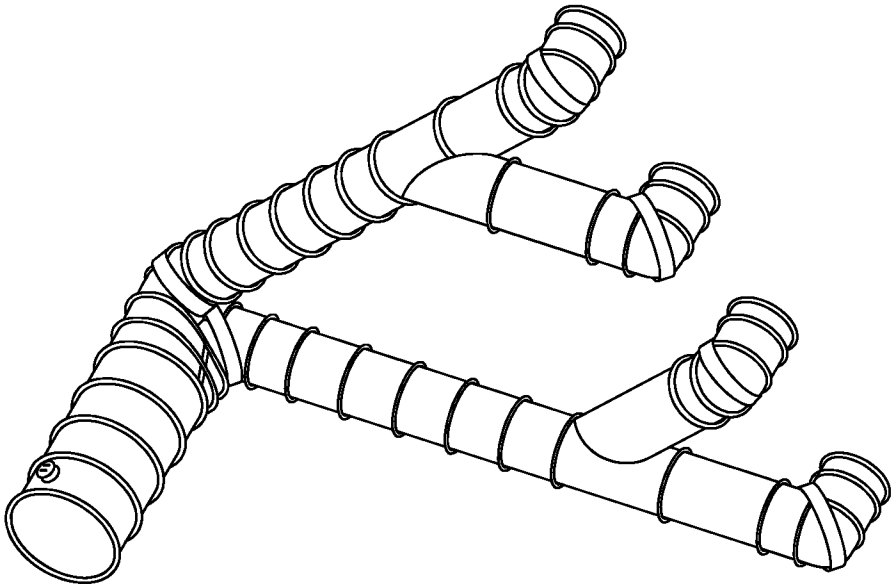
FIG. 13 is a perspective schematic view of an embodiment of an inline V turbine exhaust duct design in which the sloping risers may be bifurcated to supply more than a single street of the air cooled condenser.

FIG. 9 shows an alternative embodiment according to which a single turbine exhaust duct is diverted directly into a V-piece, featuring two sloping risers, eliminating the T-piece as well as the horizontal transfer tubes shown in FIGS. 2 and 3. Turning vanes are shop installed in the bottom of the riser elbows, and the complete elbows are delivered whole. According to this embodiment, a round-to-oval reducer element may be provided between the primary turbine exhaust duct and the elbows leading to the sloping risers. The round-to-oval reducer splits the exhaust flow in the single turbine exhaust duct into two parallel exhaust streams. The round-to-oval reducer is connected directly or indirectly to two elbow pieces, each of which is joined to a sloping riser duct. With the round-to-oval reducer, the turbine exhaust duct can be delivered in many fewer pieces; it is much lighter, and there is far less field assembly and welding as compared to the traditional intricate T piece design.

According to both the double-duct and V-shaped duct embodiments described above, the requirement for the T-shaped piece with the complicated guide vane system is eliminated. According to both designs, the overall assembly has fewer parts, is lighter in weight, and will be less expensive to supply and ship. The present designs also result in less field labor required to unload, handle, assemble and weld the turbine duct assemblies as it is delivered in fewer pieces, and reduces the amount of field welding required, reducing the amount of welding sets and welding consumables required at the site. The invention also reduces the risk and exposure to poor quality welding and poor labor efficiency at site. There will also be a resultant reduction of inspection costs as there will be many fewer field welds that need to be inspected. The new designs will, in addition, require less access scaffolding and scissor/JLG lifts. These changes all translate into a much reduced installed cost at site.

Additionally, by eliminating the T-shaped piece, the steam-side pressure drop is significantly reduced, minimizing the sub-cooling in the steam cycle, that is, the temperature difference between the ACC condensate temperature and the turbine steam temperature. This results in an improvement in the overall efficiency of the steam cycle plant heat rate. In addition, the reduction in steam side pressure drop also results in smaller ACCs and/or lower fan horsepower requirements on the ACC. The former results in lower capital investment costs; the latter results in lower plant operating costs. The reduced sub-cooling also facilitates an easier deaeration of the condensate. This reduces the corrosion in the complete steam cycle, resulting in an increase in the overall life of the power plant.

The invention claimed is:

1. A turbine exhaust duct assembly for a field-assembled air-cooled condenser comprising a single primary turbine exhaust duct connected at a first end to a turbine or to a turbine to exhaust duct transition element and connected at a second end to a first end of a single-flow-to-multiple-parallel-flow divider duct element, said single-flow-to-multiple-parallel-flow divider duct element connected at an opposite end to two or more subsidiary elbow and duct assemblies each of which is configured to supply steam to one or more streets of said field assembled air-cooled condenser, wherein said single-flow-to-multiple-parallel-flow divider duct element comprises a first end having a round cross-section with a single opening and a second end having an oval cross- section with at least two openings, and wherein first end and said second end are aligned along a single longitudinal axis of said single-flow-to-multiple-parallel-flow divider duct element.

2. A turbine exhaust duct assembly according to claim 1, wherein said subsidiary elbow and duct assemblies each comprise a single sloping riser duct, each said sloping riser duct configured to supply steam to one or more streets of said air cooled condenser.

3. A turbine exhaust duct assembly according to claim 1, wherein said turbine exhaust duct assembly is an inline V turbine exhaust duct assembly.

4. A method for substantially reducing steam-side pressure drop, minimizing sub-cooling in the steam cycle, and improving steam cycle plant heat rate of an air-cooled condenser system, comprising delivery of spent plant steam to an air cooled condenser using the turbine exhaust duct assembly of claim 1.

5. A method of reducing required size of an air cooled condenser for a specified plant steam output, comprising delivery of spent plant steam to an air cooled condenser using the turbine exhaust duct assembly of claim 1.

6. A method for lowering the fan horsepower requirements of an ACC, comprising delivery of spent plant steam to an air cooled condenser using the turbine exhaust duct assembly of claim 1.

7. A method for facilitating de-aeration of a steam condensate, reducing corrosion in the steam cycle and for increasing the life of a power plant, comprising delivery of spent plant steam to an air cooled condenser using the turbine exhaust duct assembly of claim 1.

* * * * *